US006763620B1

(12) United States Patent
Voss et al.

(10) Patent No.: US 6,763,620 B1
(45) Date of Patent: Jul. 20, 2004

(54) SELF-CLEANING NON-DRIP IRON

(75) Inventors: Norbert Voss, Offenbach (DE); Klaus Maier, Offenbach (DE); Herbert Horn, Erbach (DE); Ulrich Demuth, Erbach (DE)

(73) Assignee: ROWENTA Werke GmbH, Offenbach (DE)

( * ) Notice: Subject to any disclaimer, the term of this patent is extended or adjusted under 35 U.S.C. 154(b) by 0 days.

(21) Appl. No.: 10/469,139

(22) PCT Filed: Feb. 14, 2002

(86) PCT No.: PCT/IB02/00449

§ 371 (c)(1),
(2), (4) Date: Aug. 27, 2003

(87) PCT Pub. No.: WO02/068749

PCT Pub. Date: Sep. 6, 2002

(30) Foreign Application Priority Data

Feb. 27, 2001 (FR) ..... 01 02675

(51) Int. Cl.[7] ..... D06C 75/18
(52) U.S. Cl. ..... 38/77.83
(58) Field of Search ..... 38/77.8, 77.83, 38/77.82, 77.1, 77.5; 251/206, 318, 319, 328, 333, 359, 67, 84, 149.1, 205, 210

(56) References Cited

U.S. PATENT DOCUMENTS 3,165,843 A * 1/1965 Willman ..... 38/77.83
3,474,552 A * 10/1969 Swenson ..... 38/77.8
5,531,037 A * 7/1996 Pons et al. ..... 38/77.8
5,924,224 A 7/1999 Demuth
6,115,949 A 9/2000 Kremer
6,167,643 B1 * 1/2001 Dodier et al. ..... 38/77.8
6,295,975 B1 * 10/2001 Yew et al. ..... 123/568.2

FOREIGN PATENT DOCUMENTS

| | | |
|---|---|---|
| DE | 3 405 465 | 9/1985 |
| EP | 0 433 785 | 6/1991 |
| FR | 2 576 928 | 8/1986 |
| FR | 2 589 492 | 5/1987 |
| FR | 2 766 214 | 1/1999 |
| FR | 2 769 925 | 4/1999 |
| FR | 2 776 680 | 10/1999 |
| FR | 2 813 894 | 3/2002 |
| WO | WO 99/45190 | 9/1999 |

* cited by examiner

*Primary Examiner*—Ismael Izaguirre
(74) *Attorney, Agent, or Firm*—Browdy and Neimark, P.L.L.C.

(57) ABSTRACT

The invention relates to a steam iron with instantaneous vaporization comprising a water container (2), a steam chamber (32), an anti-drip device (80) and a drip device having a rod (4) which moves axially. According to the invention, the total stroke of the axially-moving rod (4) comprises a first stroke which provides the flow of water through the opening (520) of a module (5) that receives the water from the container (2) via the anti-drip device (80) and a second stroke which simultaneously opens a direct passage for the water to flow from the container (2) to the module (5) and moves the module (5) by opening a larger hole for the water to flow from the container to the steam chamber.

4 Claims, 5 Drawing Sheets

61
6
24
23
42
4
210
41
2
11
21
10
9
7
8
5
25
70
22
80
3
31
35
36
330
222
34
33
32

SELF-CLEANING NON-DRIP IRON

The present invention concerns steam pressing irons and principally irons having a self-cleaning device permitting cleaning of the steam chamber by abruptly precipitating therein a large quantity of water.

There are known the patent DE3405465 and the patent FR2769925 describing forms of construction of this type of iron, and patent application FR00/11562 that is an improved, advantageous form of construction. But these forms of construction have the drawback of not having a non-drip device to halt the flow of water to be vaporized during ironing when the iron is insufficiently hot.

Inversely, there is known the patent U.S. Pat. No. 5,924,224 that describes an iron having an effective non-drip function but not a self-cleaning function.

Among the irons that provide at the same time a self-cleaning function and a non-drip function, there is known a form of construction described in the patent FR2766214. But the cleaning function is effectuated by removing the rod that supports the plug of the drip device, which is not very practical. There is also known the patent WO9945190. Its description concerns a drip device in series with a non-drip device, the entirety being short-circuited by a self-cleaning valve, the manual control of which is separated from the drip control, which complicates the iron and its utilization.

The object of the invention is an economical, reliable steam pressing iron having a self-cleaning function and a non-drip function, not having the drawbacks cited.

Mainly, the object of the invention is achieved by a steam iron with instantaneous vaporization having a water reservoir, a steam chamber, a non-drip device, and a drip device having an axially displaceable rod characterized in that the total stroke of the axially displaceable rod comprises a first stroke assuring the flow of water for vaporization through the orifice of a module receiving water from the reservoir through the non-drip device, and a second stroke that simultaneously opens a direct passage for water from the reservoir toward the module and displaces the module while opening a larger orifice for the passage of water from the reservoir toward the steam chamber.

Thus, during normal ironing, water from the reservoir must pass through the non-drip device before reaching the module, then the steam chamber. The user regulates the position of the axially displaceable rod by the steam control.

When she wants to clean her iron, it is sufficient to completely push in the steam control. The rod then carries along the module, which opens a large passage for water, on the one hand between the reservoir and the module, on the other hand between the water surrounding the module and the steam chamber. The same control is thus utilized on the one hand to assure regulation of the steam flow rate and on the other hand to execute self-cleaning. When the self-cleaning takes place, the soleplate of the iron cools rapidly, but the non-drip is short-circuited and cannot oppose completion of the operation.

Advantageously, the control of vaporization and of self-cleaning comprises a cam acting on the rod, a first part of the cam having a slope that is shallower than the coefficient of friction of the materials in contact with the rod of the cam, and a second part of the cam having a steeper slope than said coefficient of friction.

Because of the shallow slope of the first part of the cam, its positioning is stable. This first part is suitable for the stroke of the axially displaceable rod during which water is vaporized.

The second part of the cam can assure the second part of the total stroke of the rod when one desires to perform self-cleaning. This steeper slope causes the positioning to be reversible, and the control more difficult, which avoids an accidental control of the self-cleaning. The user must maintain the control during this operation that is relatively infrequent, but rendered easy by these arrangements.

Preferably, the orifice of the module, the large orifice for passage of water opened by the module, the direct passage for water from the reservoir toward the module are circular and on the same axis.

As a result, the water circuit between the reservoir and the steam chamber is very short. The entrance of water into the chamber is abrupt and effective. The structure of the iron can be compact.

Preferably, the drip device and the module are contained in a vertical tubular body that isolate them from the water reservoir during ironing, the tubular body having at its lower part a tubular sealing joint, retractable with the module in the second stroke of the axially displaceable rod.

Due to this arrangement, the opening of a direct passage for the water from the reservoir toward the module is simplified. The module can directly carry along the joint by raising it without any mechanical intermediary.

The invention will be better understood in view of the examples herebelow and the attached drawings.

FIGS. 4*a* to 4*d* are a group of four views in cross-section of the drip device in different regulatable positions.

Figure 5:
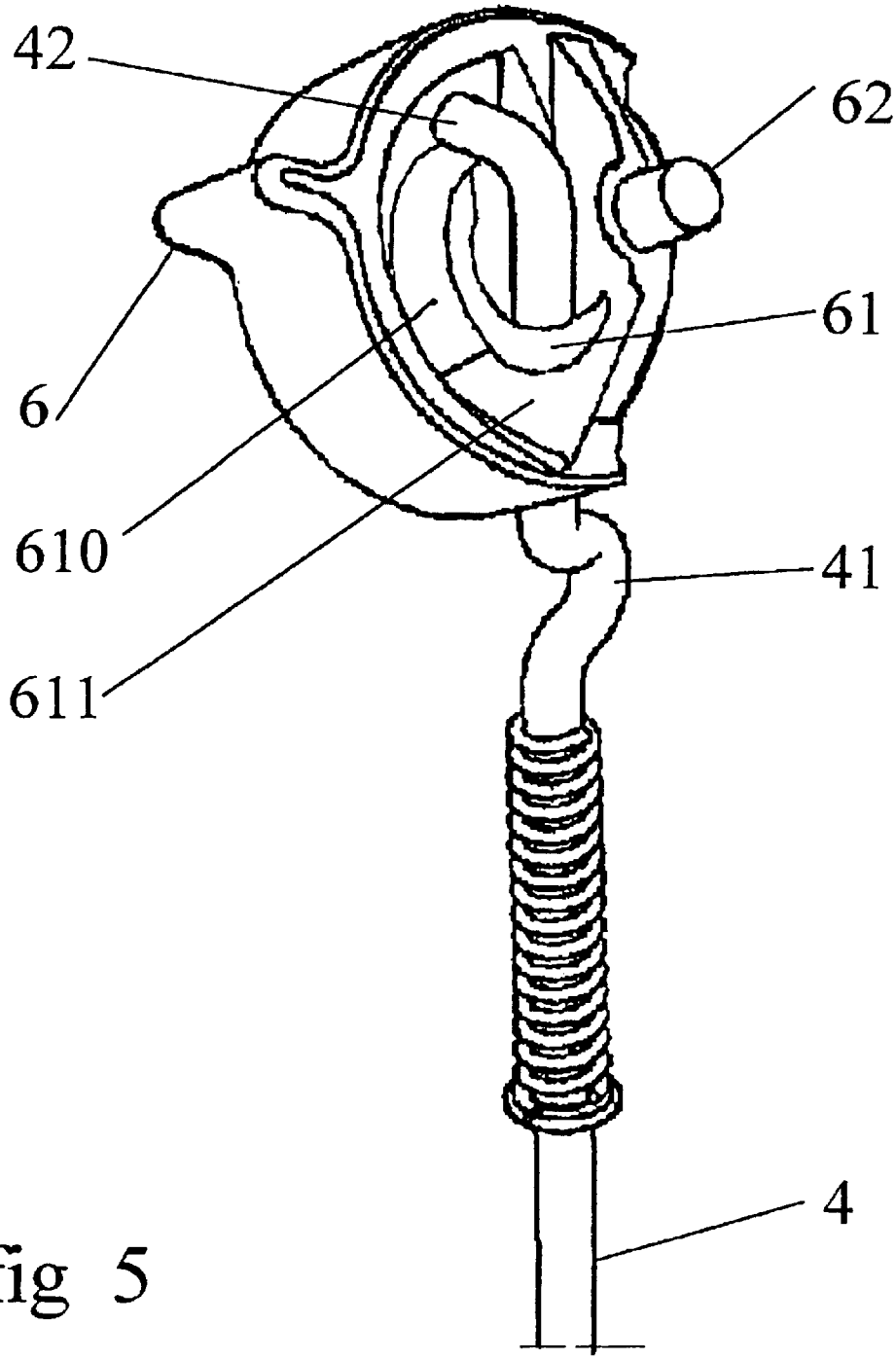

FIG. 5 is a perspective view of the drip control.

Figure 1:
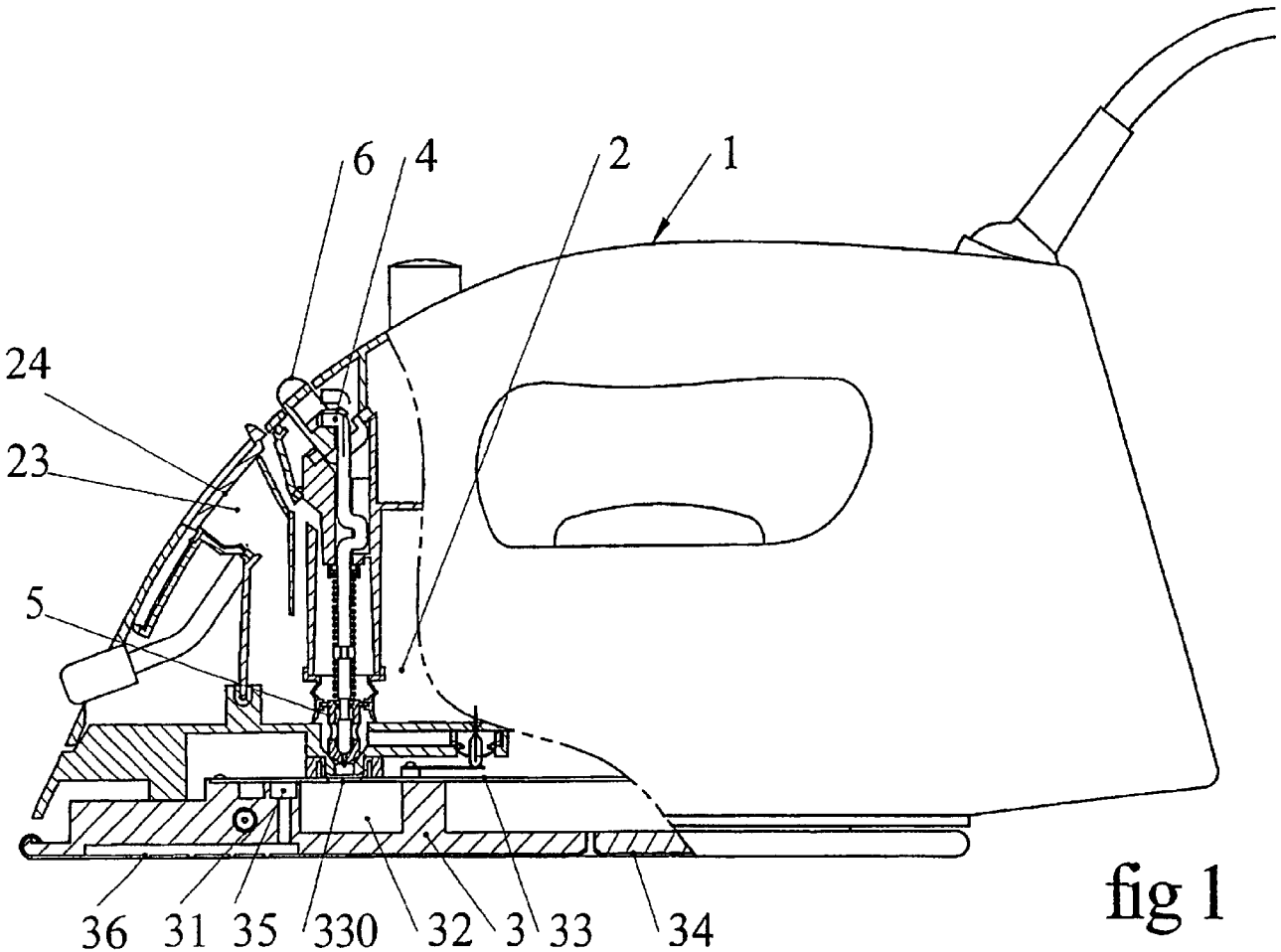
FIG. 1 is a longitudinal view of a pressing iron according to the invention, in partial cross-section of the front of the iron.

In a preferred from of construction (FIGS. 1 and 2), steam iron 1 has a reservoir 2 in two main parts 21, 22, and having a filling orifice 23 closed by a cover 24, a heating body 3 furnished with a heating element 31, a steam chamber 32 in heating body 3 being closed by a plate 33, a thin soleplate 34 in thermal contact with heating body 3 forming the surface in contact with fabrics during ironing. Distribution channels 35 and steam holes 36 in heating body 3 and soleplate 34 assure evacuation of steam on the fabric.

Closing plate 33 is pierced by a hole 330 (FIGS. 2 and 3) in the axis of a drip device through which water to be vaporized is introduced into steam chamber 32. The drip device having a module 5 is housed in a shaft constituted by the part 21 and the part 22 of the reservoir. A joint 70 in the form of a bellows assures the sealing between the two parts at this location. Joint 70 carries at one end a lip 71 in contact with the part 22 during normal use of the iron in a manner such that water from the reservoir normally arrives around module 5 only through a channel 222. The end of joint 70 carrying lip 71 is fixed to module 5 and can be displaced with it.

A non-drip valve 80 controls the passage of water from reservoir 2 toward channel 222 and module 5. This valve has a passage orifice 81 that can be closed by a needle 82 moved by a bimetallic strip 83 substantially at the temperature of the heating body 3. The non-drip valve is open when the iron is ready to steam iron, closed when the iron is too cold.

The sealing between the bottom 22 of the reservoir carrying the drip device and closing plate 33 is assured by a joint 25.

Figure 2:
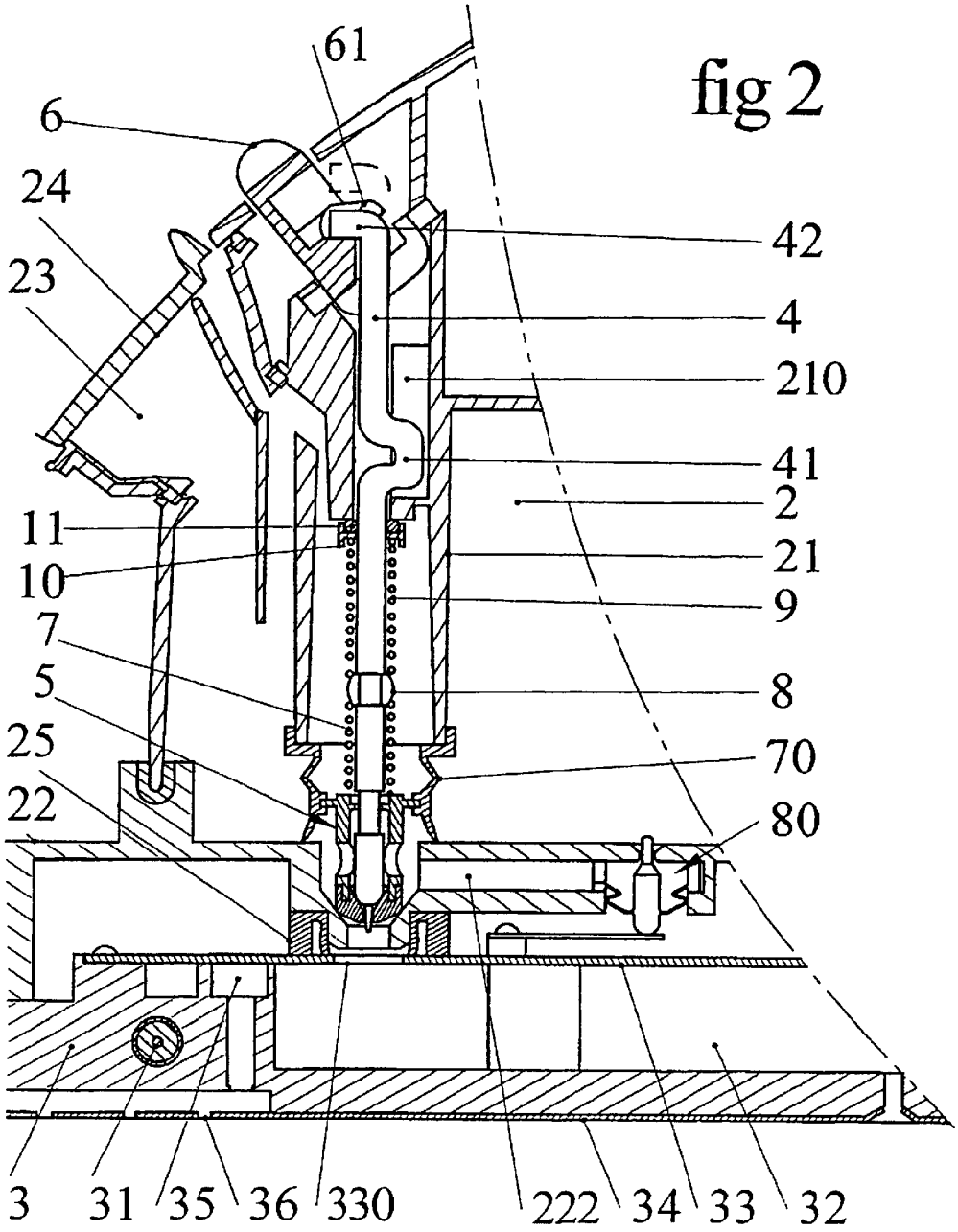
FIG. 2 is a longitudinal partial cross-section of the iron in the region of the drip valve.

As is better seen in FIG. 2, the drip device has a rod 4 that is biased toward the bottom by a spring 9, a control 6 displacing rod 4 axially, a module 5 biased toward the bottom by a spring 7 that is less hard than the preceding.

Rod 4 has on a part of its length a U 41 perpendicular to its axis. This U introduced into a slot 210 of the reservoir assures immobilization of rod 4 in rotation. The upper end 42 of rod 4 is bent in order to bear on a cam 61 of control 6. A washer 10 constitutes with a sealing joint 11 the support for spring 9 on reservoir part 21 while a stamped part 8 of rod 4 constitutes its support on rod 4. Stamped part 8 equally serves as a support for spring 7.

Control 6, better seen in FIG. 5, is a button that can turn on journal pins 62. In a convenient fashion permitting a good integration of the control with the housing of the iron, the journal pin axis cuts the axis of rod 4 along an oblique line and cam 61 is designed accordingly.

Cam 61 has surface 610 that lifts the rod by its end 42 with a first slope and a second smooth surface 611 continuing from the first surface lifting the rod along a second slope that is steeper than the first. The shallow slope of surface 610 permits maintenance of rod 4 in the position where it has been lifted while surface 611 with a steep slope does not permit maintenance in position when the user releases the control.

Figure 3:
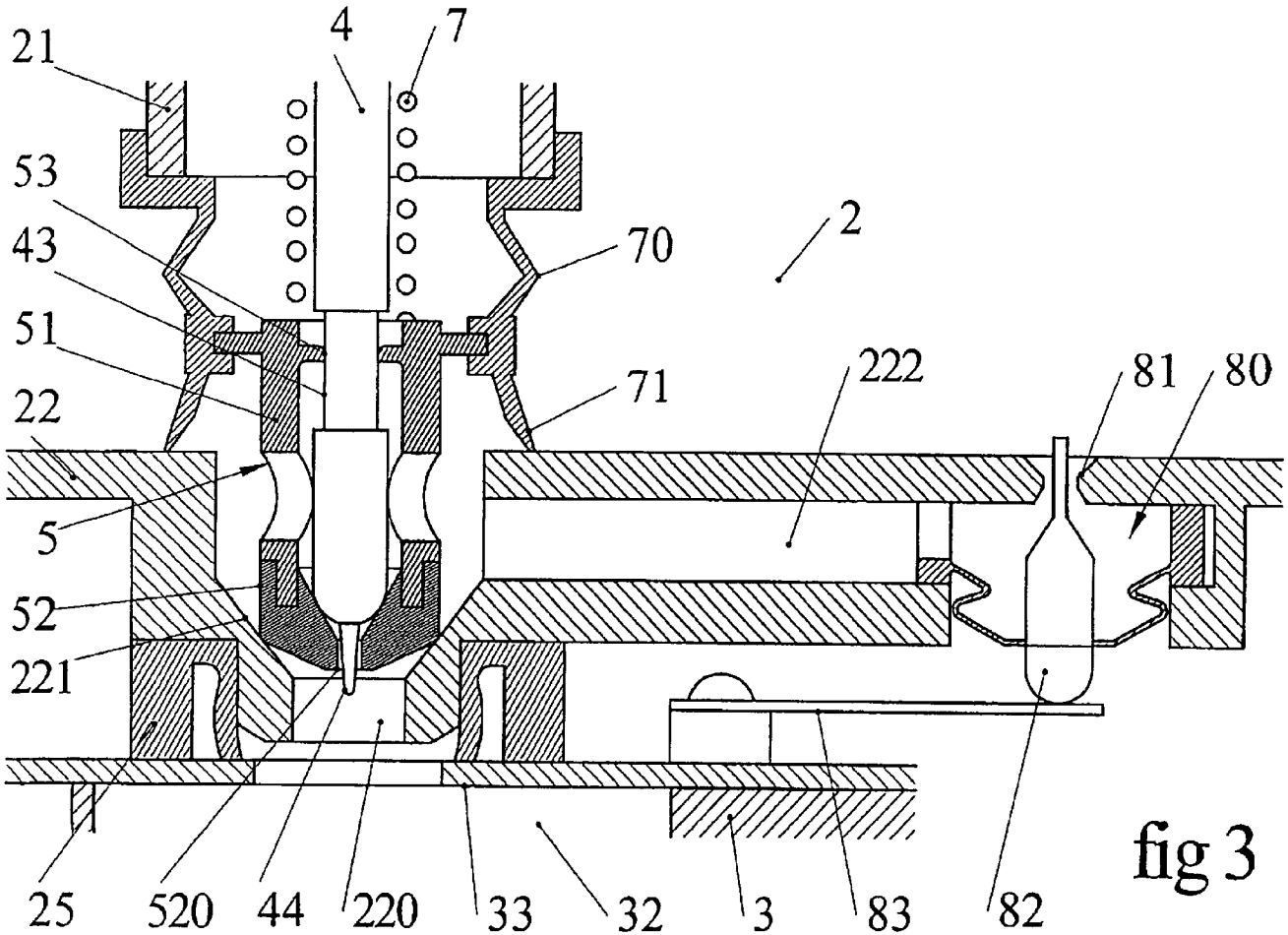
FIG. 3 is a detailed view in cross section of the assembly of the drip valve and the non-drip valve.

Module 5, better seen in FIG. 3, has a substantially cylindrical hollow piece 51 that allows the end of shaft 4 to pass and is snap-fitted by a lip 53 into a groove 43 of this rod. More particularly, according to the invention, the stroke of rod 4 in the module is thus limited by the width of groove 43. A cylindrical part 52 of elastomer is fixed at the end of the module.

This part 52 is pierced by a calibrated orifice 520 and constitutes a compressed elastomer seat for the rounded end of rod 4 pushed by spring 9. Sealing is thus assured between the housing of the drip device and part 51 of the module the same as between the housing of the drip device and orifice 520 feeding the steam chamber. A slightly conical extension 44 of rod 4 passes through orifice 520 and assures the cleaning thereof at each maneuver while permitting a progressive opening of the passage in orifice 520 when rod 4 is lifted. The exterior of the elastomer part pushed toward the bottom by spring 7 constitutes on its circular peripheral end a joint that bears while being compressed on a seat 221 of the lower part 22 of the reservoir. The elastomer part obstructs an orifice 220 concentric to orifice 520 but of much larger cross-section. Sealing is thus assured between the reservoir and part 51 of the module the same as between the reservoir and orifice 220 feeding steam chamber 32.

Part 52 is solid and of one piece between the seat of rod 4, the span on seat 221 of part 22 and orifice 520, in a manner such that the sealing realized by construction on part 51 of the module is not critical, no leak toward chamber 32 being able to be produced between the span of rod 4 and the span on seat 221.

In a preferred form of construction, part 52 of silicone elastomer LSR (LSR is used for Liquid Silicon Rubber) has a hardness of the order of 50 Shore. Orifice 520 for the flow water for vaporization has a diameter of the order of 1 to 1.5 millimeters in order to control flow rates of the order of 25 to 30 grams of water per minute. The end of rod 4 bears on a conical seat of part 52, the apex angle of which is around 60°, permitting a good support of the edges on part 51 of module 5. Orifice 220 for the flow of self-cleaning water has a diameter of the order of 5 millimeters. Part 52 bears on a conical seat 221, the apex angle of which is of the order 75° for a good centering and a good compression of part 52 under the action of spring 7. Preferably, rod 54 bears on its seat in a higher zone than the bearing zone of elastomer part 52 on cone 221. By this arrangement, it results that part 52 is above all compressed when at rest under the action of the springs.

The water being cold, the water contained in reservoir 2 is blocked by non-drip valve 80 and joint 70 and cannot flood steam chamber 32. When the user causes the iron to heat up and the temperature of the iron is sufficient to assure steaming, water contained in reservoir 2 passes through non-drip valve 80 then enters channel 222 in the shaft containing the drip device.

Figure 4A:
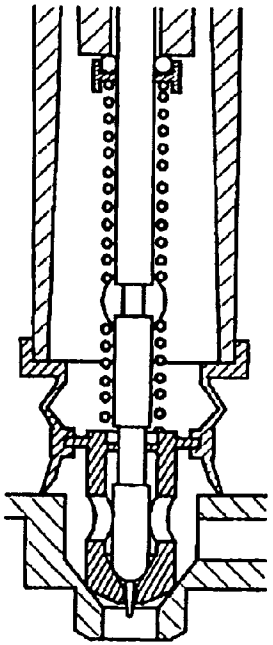

In the position of rest and ironing stoppage, water is prevented from passing toward steam chamber 32 through large orifice 220 because part 52 is pressed on seat 221 by spring 7. Water penetrates to the interior of module 5 but is prevented from passing through orifice 520 since rod 4 is pushed against its elastomer seat by spring 9. This rest position is illustrated in FIG. 4*a*.

Figure 4B:
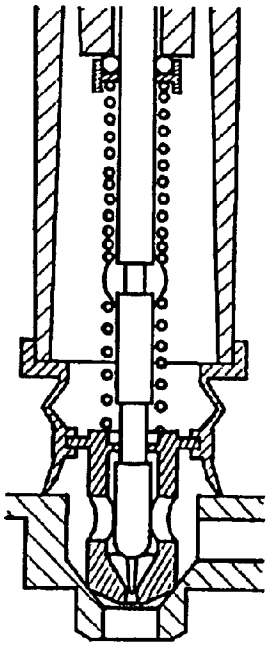

In FIG. 4*b*, the user has acted on button 6 and surface 610 of cam 61 has lifted rod 4 in opposition to spring 9. Rod 4 is no longer pressed on its seat and water can flow through orifice 520 with a flow rate that depends on the height position of rod 4 and of its extension 44. Module 5 remains pressed against seat 221 by spring 7, and lip 71 of joint 70 always assures a seal between reservoir 2 and the drip housing.

Figure 4C:
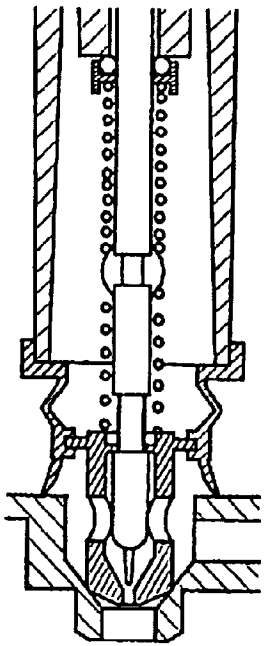

FIG. 4*c* shows the maximum position of the drip device when the iron produces steam continuously at a full rate. This position is the end of the steam stroke. Extension 44 of rod 4 has completely disengaged from orifice 520 and water flows at the maximum rate toward the steam chamber. Lip 53 of module 5 is at one end of groove 43 of rod 4 while the upper end of rod 4 is at the limit of surfaces 610 and 611 of cam 61.

Figure 4D:
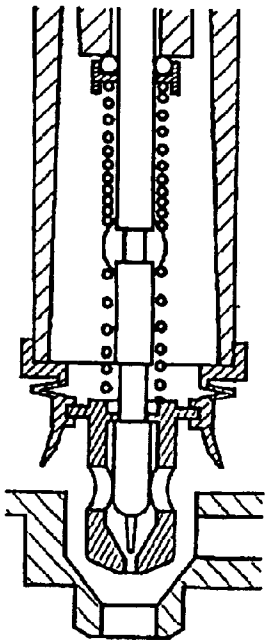

One sees in FIG. 4*d* the position of the drip device when the user pushes the control 6 fully, along a stroke that permits self-cleaning, starting from the preceding position. Upper end 42 of rod 4 is in equilibrium on surface 611 of cam 61 maintained by the pressure on the control that opposes the restoring action of spring 9. Rod 4 has carried module 5 via lip 53 attached on an edge of groove 43. By this fact, part 52 of module 5 is lifted and no longer assures sealing toward orifice 220 of large cross-section. Lip 71 of joint 70 carried along by module 5 is lifted and no longer assures sealing between reservoir 2 and module 5. Water flows from reservoir 2 toward module 5 without passing through non-drip valve 80, then toward chamber 32 with a large flow rate that assures self-cleaning of the iron.

The iron is cooled abruptly in this operation and the non-drip valve closes before the end of self-cleaning. But this closing is without consequence since the passage of water is assured by the lifting of joint 70.

The slope of surface 611 of the cam being steeper than that of surface 610, the control becomes more difficult when one wants to perform self-cleaning of the iron, and this action cannot be obtained through error. This steep slope has for advantage to facilitate the return by spring 9 into the normal steaming position. It thus suffices for the user to release the command in order to end self-cleaning.

By these means, one obtains a steam iron having a non-drip function and a self-cleaning function that are easy to use with an optimized size.

What is claimed is:

1. Steam iron with instantaneous vaporization having a water reservoir (2), a steam chamber (32), a non-drip device (80), and a drip device having an axially displaceable rod (4) characterized in that the total stroke of the axially displaceable rod (4) comprises a first stroke assuring the flow of water for vaporization through the orifice (520) of a module (5) receiving water from the reservoir (2) through the non-drip device (80), and a second stroke that simultaneously opens a direct passage for water from the reservoir (2) toward the module (5) and displaces the module (5) while opening a larger orifice for the passage of water from the reservoir toward the steam chamber.

2. Iron according to claim 1 characterized in that the control (6) of vaporization and of self-cleaning comprises a cam (61) acting on the rod (4), a first part (610) of the cam (61) having a slope that is shallower than the coefficient of friction of the materials in contact with the rod of the cam, and a second part (611) of the cam (61) having a steeper slope than said coefficient of friction.

3. Iron according to claim 1 characterized in that the orifice (520) of the module (5), the large orifice (220) for passage of water opened by the module (5), the direct passage for water from the reservoir (2) toward the module (5) are circular and on the same axis.

4. Iron according to claim 3 characterized in that the drip device and the module (5) are contained in a vertical tubular body that isolate them from the water reservoir (2) during ironing, the tubular body having at its lower part a tubular sealing joint (70), retractable with the module (5) in the second stroke of the axially displaceable rod (4).

* * * * *